US005532716A

United States Patent [19]

Sano

[11] Patent Number: 5,532,716

[45] Date of Patent: Jul. 2, 1996

[54] RESOLUTION CONVERSION SYSTEM

[75] Inventor: Yoshinobu Sano, Tokyo, Japan

[73] Assignee: Kabushiki Kaisha Toshiba, Kawasaki, Japan

[21] Appl. No.: 988,314

[22] Filed: Dec. 9, 1992

[30] Foreign Application Priority Data

Dec. 9, 1991 [JP] Japan ..... 3-324156

[51] Int. Cl.[6] ..... G09G 5/00

[52] U.S. Cl. ..... 345/132; 345/127

[58] Field of Search ..... 345/132, 213, 345/127, 137, 131

[56] References Cited

U.S. PATENT DOCUMENTS 4,153,896 5/1979 White ..... 345/131
4,680,720 7/1987 Yoshii et al. ..... 345/137
4,891,702 1/1990 Nakayama ..... 345/127
4,916,747 4/1990 Arimoto ..... 345/127

*Primary Examiner*—Curtis Kuntz
*Assistant Examiner*—Vivian W. Chang
*Attorney, Agent, or Firm*—Foley & Lardner

[57] ABSTRACT

A memory storing image data at a m1×n1 (horizontal to vertical) dot resolution is read out at a horizontal scanning rate corresponding to a first clock signal at a frequency $f_1$. Data read out from the memory is latched in a first storage device in response to the first clock signal. An output from the first storage device is latched in a second storage device in response to a second clock signal at a frequency $f_2$. The rate $f_2$ is selected to be less than $f_1$ and to correspond to the desired display rate of the display device having a pixel resolution of m2×n2. $f_1$ and $f_2$ are related such that $f_1/f_2$= (m1/m2). The difference in frequencies causes some of the X address from the memory to be dropped and not stored in the second storage device thereby resulting in the desired data conversion in the X direction. The Y address is incremented by an amount equal to n1/n2 to affect the resolution conversion in the Y direction.

9 Claims, 2 Drawing Sheets

RESOLUTION CONVERSION SYSTEM

BACKGROUND OF THE INVENTION

1. Field of the Invention

The invention relates to a resolution conversion system which, for example, permits display of data in a different resolution than that stored in a memory.

2. Description of the Related Art

Recently data processing apparatus such as personal computers utilize a high resolution data storage for image display, for instance 900 by 1152 pixels. In order to display the image data stored in memory on a display such as a liquid crystal display, plasma display, etc., it is usual to use a display with the same resolution as that of the memory. However, when the memory is large enough to permit high-resolution storage of image data, a display is generally chosen to have a comparable high-resolution even though such a high resolution display may not be needed. Thus the cost of the system becomes quite expensive.

To reduce cost when high-resolution is not required, a display with low-resolution is employed. In such systems the contents in the high-resolution memory is converted to be suitable for use with a low-resolution display.

One known method of converting image data of high resolution into suitable low resolution for a display uses software image data processing.

Another method involves converting the image data in the high resolution memory into image data stored in another memory at a lower resolution.

However, in the first method mentioned above, if a suitable algorithm for the resolution conversion is used, the resolution conversion is achieved with high-quality but the time for converting is unacceptably long. In the second method, an additional memory is required which adds to the cost of the equipment, and additional time is required in converting the higher resolution data into the second memory of lower resolution.

SUMMARY OF THE INVENTION

It is therefore an object of the invention to provide a resolution conversion system capable of performing resolution conversion at high speed utilizing small-scale hardware.

In order to achieve the above-mentioned object of the invention, there is provided a resolution conversion system, having a memory, an address generator, a first and second storage device and a display device. The resolution conversion system operates to transform the data stored in the memory, which is stored at a first predetermined resolution, to provide data to the display device for display at a second predetermined resolution.

The address generator is connected to the memory and generates an address for reading out the stored data in the memory. The first storage device is connected to the memory and stores therein the data read out in response to the address from the address generator. The first storage device outputs the stored data in response to a first clock signal having a frequency $f_1$.

The second storage device is connected to the first storage device and the display device. The second storage device operates in response to a second clock signal having a frequency $f_2$, which is different from the frequency $f_1$ of said first clock signal. The second storage device stores therein only selected data from the first storage device, and outputs this selected data to the display device. In this manner only selected portions of the X addressed image date in the memory are displayed on the display.

In accordance with another aspect of the invention, there is provided a method of transmitting selected portions of data stored in a m1×n1 memory to a m2×n2 display device where m1, m2, n1, n2 are integers with m2<m1. The method entails the steps of addressing data stored in the memory, reading out data stored in the memory, storing the read out data from the memory into a first storage device, transmitting data from the first storage device to a second storage device at a first rate $f_1$, storing data in the second storage device at a second rate $f_2$ less than the first rate $f_1$, and selecting $f_1$ and $f_2$ such as to satisfy the relationship $$f_1/f_2=(m1/m2).$$

In this manner, the X addressed data in the memory may be converted or compressed so as to be displayed on the lower resolution display device.

BRIEF DESCRIPTION OF THE DRAWINGS

The accompanying drawings, which are incorporated in and constitute a part of the specification, illustrate preferred embodiments of the invention, and together with the general description given above and the detailed description of the preferred embodiments given below, serve to explain the principles of the invention.

DETAILED DESCRIPTION OF THE PREFERRED EMBODIMENTS

A resolution conversion system according to preferred embodiments of the invention is described with reference to the accompanying drawings.

Figure 1:
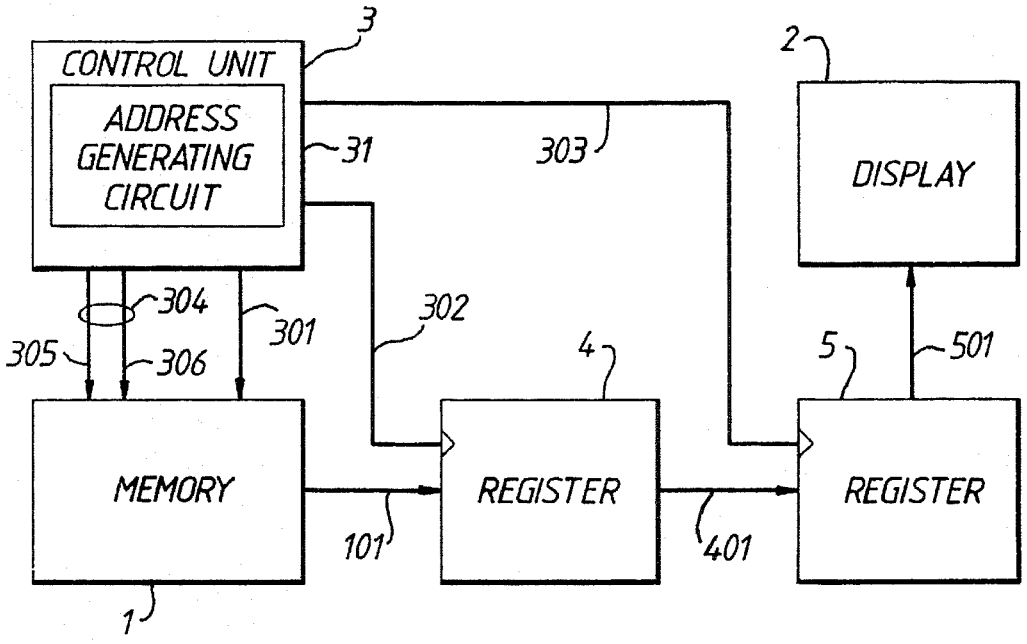
FIG. 1 is a block diagram showing an embodiment of the invention.

As shown in FIG. 1 the resolution conversion system according to the invention has a memory 1, a display 2, a control unit 3 and registers 4 and 5.

The memory 1 stores data indicating image data to be displayed. The display 2 such as, for example, a liquid crystal display, a plasma display, etc., displays the image data read out from the memory 1. The control unit 3 converts the image data to match the resolution of the display 2 and generates a memory control signal along line 301 fed to the memory 1 and clock signals having different frequencies along lines 302 and 303. The clock signal along line 302 has a frequency $f_1$, and the clock signal along line 303 has a frequency $f_2$. The ratio $f_1$ to $f_2$ is set to correspond to the size in the X direction (see FIG. 2) of the memory 1 to the size in the X direction of the display 2.

Further, the control unit 3 has an address generating circuit 31 generating an address along line 304 in order to read out the image data stored in the memory 1. The address generated by the address generating circuit 31 consists of an X address along line 305 and a Y address along line 306. The X address represents the direction of horizontal scanning (see FIG. 2) of the memory 1. The Y address represents the direction of vertical scanning (see FIG. 2) of the memory 1.

The register 4 latches the image data read out from the memory 1 along line 101 in response to the $f_1$ clock signal along line 302. The first register 4 may comprise, for example, a m1×1 register operating in a first-in/first-out manner. The $f_1$ clock signal along line 302 operates on the register for both latching data into the register received along line 101 and also for reading data out of the register along line 401. The register 5 latches the data output from register 4 along line 401 in response to the $f_2$ clock signal along line 303 and outputs display data along line 501 to the display 2 at this same clock rate. The second register 5 also operates in a first-in/first-out manner and may be fabricated in a m2×1 array.

Figure 2:
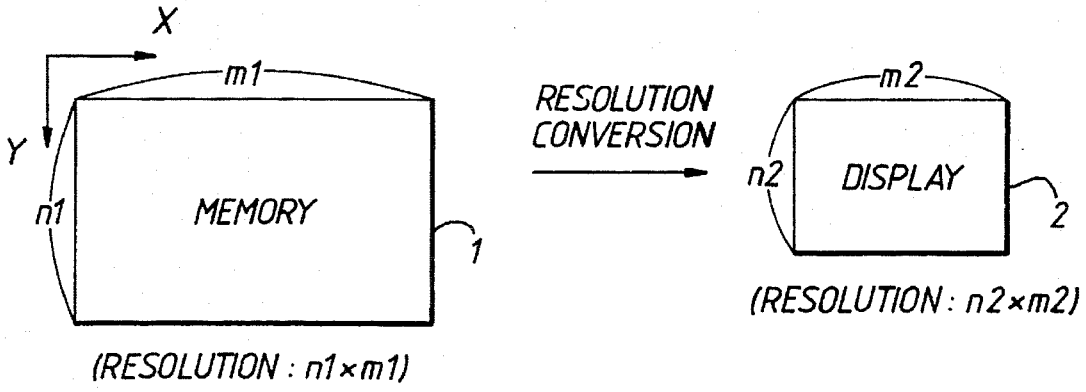
FIG. 2 is a view showing the resolution conversion from a memory to a display.

As shown in FIG. 2, the resolution of the memory 1 is n1 dots wide (the Y direction) and m1 dots long (the X direction), and the resolution of the display 2 is n2 dots wide (the Y direction) and m2 dots long (the X direction).

Consequently, in order to display the data in the memory 1 on the display 2, the resolution of the memory 1 must be converted into the resolution of the display 2.

By way of example, m1 may be 1152 dots, n1 may be 900 dots, m2 may be 620 dots, and n2 may be 480 dots.

Next, the address generating circuit 31 will be described. The address generating circuit 31 has a Y address generating part. The Y address generating part performs resolution conversion of the direction of the vertical scanning (the Y direction).

Figure 3:
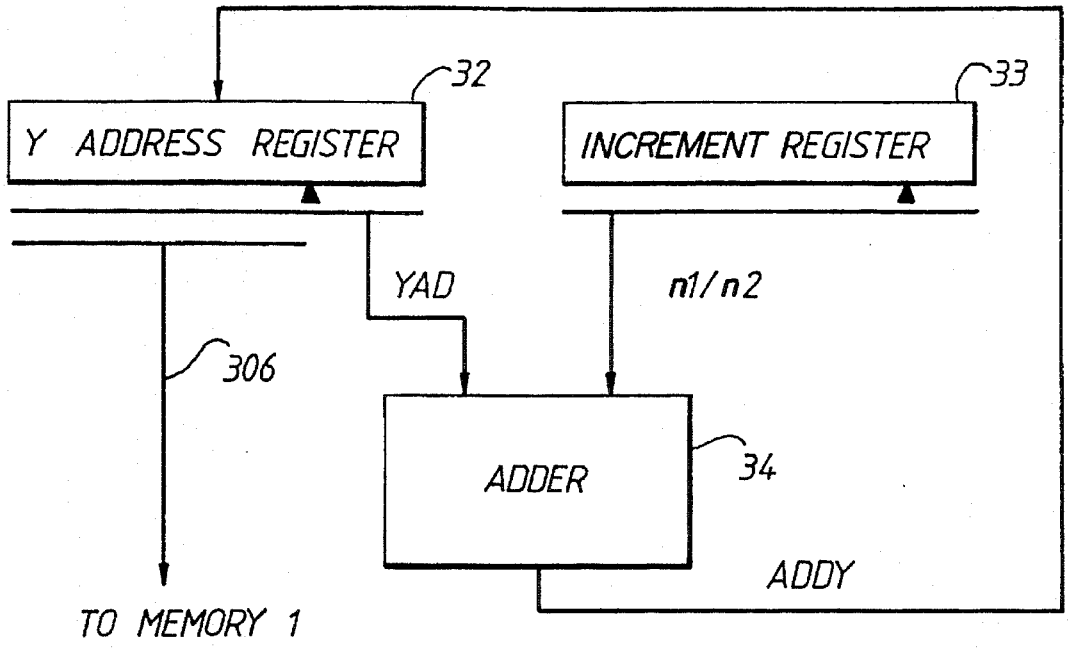
FIG. 3 is a block diagram showing the Y address generating part of the address generating circuit shown in FIG. 1.

As shown in FIG. 3, the Y address generating part has a Y address register 32, an increment register 33 and an adder 34.

The Y address register 32 stores a Y address containing an integral and a decimal portion. The increment register 33 holds the ratio (n1/n2) which includes an integral part and a decimal part. The adder 34 adds an output from the increment register 33 to an output from the Y address register 32. The added result of the adder 34 is stored in the Y address register 32 as a new Y address (integral and a decimal part). The integral part of the output from the Y address register 32 is transmitted into the memory 1 as the Y address along line 306. The cycle repeats for subsequent Y addresses. With each Y address, an X address is generated along line 305. The X address is generated in normal fashion to sequentially address consecutive pixel information in the memory 1 along the x or horizontal direction.

The operation of the invention is now described.

Figure 4:
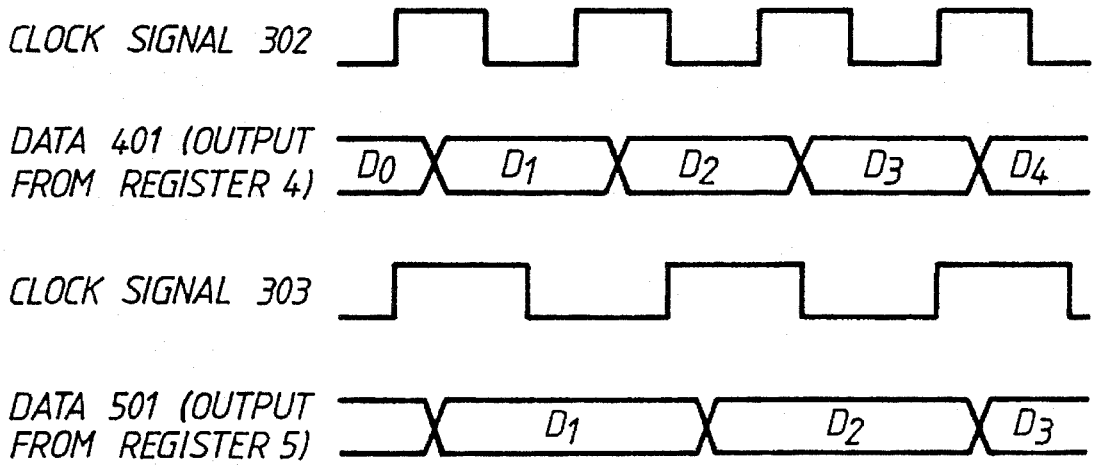
FIG. 4 is a timing charge showing the operation for the resolution conversion in the X direction.

As shown in FIG. 4, when the data in the memory 1 is displayed on the display 2, the address generating circuit 31 generates and outputs the X address 305 synchronized with the $f_1$ clock signal along line 302 (e.g., the X address may be generated in response to the clock signal of frequency $f_1$) and executes the horizontal scanning operation. Further, the address generating circuit 31 generates and outputs the Y address 306 while the horizontal scanning is executed.

The X address 305 and the Y address 306 are provided to the memory 1 as the address 304. Further the memory control signal 301 is provided to the memory 1, and the data is read out from the memory 1 synchronized with the clock signal 302.

Specifically, with regard to the Y address, the Y address register 32 holds a Y address having a decimal part YAD. An initial value of the integral part of the Y address is the leading Y address in the memory 1 and its decimal part YAD is initialized at zero.

The adder 34 adds the increment n1/n2 to the present Y address (including the decimal part YAD) and generates a new Y address, ADDY (including a decimal part).

The generated new Y address ADDY is transmitted into the Y address register 32. As one horizontal scanning line finishes, the transmitted Y address ADDY is written in the Y address register 32.

Consequently the data in the Y address register 32 is increased by the ratio m1/m2 every horizontal scanning period. The integral part of the output from the Y address register 32 is provided to the memory 1 as the Y address along line 306.

Since the address 304 provided to the memory 1 is converted according to the ratio n1/n2 for the Y addresses, the proper Y memory locations are selected and read out of memory 1 as part of the converted image data D0, D1, D2, D3, D4 etc. as shown in FIG. 4. The Y converted image data along line 101 is transmitted into the register 4 and latched into the register 4 in response to the clock signal 302. The Y converted image data is read out of the register 4 at the clock rate $f_1$ and fed to the second register 5 along line 401.

However, the X address data is not yet converted as this conversion takes place as a result in the difference in frequencies between the clock signals $f_1$ and $f_2$. The ratio of $f_1$ to $f_2$ is selected to be that of the ratio m2/m1 to achieve the desired data conversion. As the frequency $f_1$ of the clock signal 303 is preferentially determined in advance as the computer system clock frequency, the frequency $f_2$ of the clock signal 302 is calculated by equation (1) below:

$$f_2=(m2/m1).\ f_1 \qquad (1)$$

The Y converted image data along line 401 is synchronized with the clock signal $f_1$ along line 302 as shown in the first two graphs of FIG. 4. However, not all of this data is latched into the second register 5 since the data latching rate for the second register 5 is at a rate $f_2$ which is less than the rate $f_1$ at which data appears on the line 401. Thus, as seen from FIG. 4 the sequence of data which is latched into register 5 is D0, D2, D3, D5 etc. Thus, not all image data are latched into register 5, but only those image data points which are present at the input to the latch 5 in synchronism with the rising edge of the $f_2$ clock signal. The number of image data points latched into register 5 is determined by equation (1) above.

Utilizing equation (1), the desired conversion ratio in converting the image data in the X direction from the m1 memory length to the m2 display length may be achieved. As a result, the is no need for a X address generating circuit similar to that shown in FIG. 3 for the Y address generation.

Since only the data which is latched into the second register 5 is transmitted to the display 2 along line 501, the display 2 receives the image data which is converted in both the X and Y directions. The converted image data output from line 501 from the register 5 is transmitted to the display 2, and displayed on the display 2 in response to the clock signal 303.

Since the resolution conversion is executed by hardware without the need for an additional memory and time consuming software, the conversion can take place at high speed. Further, the resolution conversion system is compact and inexpensive.

In an alternate embodiment of the invention, the first register 4 may be replaced by a m1×n1 memory with the Y and X address conversions taking place in the same manner as described above.

Modification of improvements of the invention will be apparent to those of skill in the art, and the invention is intended to cover all such modifications and improvements which come within the scope of the appended claims.

What is claimed is:

1. A resolution conversion system having a memory for storing data at a first predetermined resolution and a display device for displaying data at a second predetermined resolution different from the first predetermined resolution, said conversion system comprising:

address generating means connected to said memory and generating an address for reading out the stored data in the memory;

a first storage device connected to said memory and storing therein the data read out in response to the address from the address generating means, said first storage device outputting said stored data in response to a first clock signal having a frequency $f_1$; and a second storage device connected to said first storage device and said display device, and second storage device operating in response to a second clock signal having a frequency $f_2$, different from the frequency $f_1$ of said first clock signal, for storing therein only selected data from the first storage device, said second storage device outputting the selected data stored therein to the display device, said first storage device having an output and said second storage device having an input connected to the output of said first storage device, and said second storage device selecting for storage therein only the data appearing on said input which is in synchronism with a rising edge of said second clock signal at said frequency $f_2$, wherein the first predetermined resolution corresponds to a storage size within said memory of n1×m1, and said second predetermined resolution corresponds to a display size of said display device of n2×m2, and wherein $f_1$ and $f_2$ are related according to the formula:

$$f_2=(m2/m1).f_1.$$

2. A resolution conversion system according to any one of claim 1 wherein the address generating means comprises a Y address generating circuit converting the first predetermined resolution of the memory to the second predetermined resolution of the display device in a vertical scanning direction.

3. A resolution conversion system according to claim 2, wherein the Y address generating circuit comprises:

an increment register which stores the ratio of the vertical scanning resolution in the memory to the vertical scanning resolution in the display device;

a Y address register storing a current Y address;

an adder adding the address from the Y address register and the increment register; and means for feeding the output of the adder to the Y address register as a new current address.

4. A resolution conversion system according to claim 3, wherein said Y address register stores an integral part and a decimal part, and said conversion system further comprises means for feeding the integral part of said Y address register to said display device.

5. A resolution conversion system according to claim 1, wherein the ratio the frequency $f_1$ of the first clock signal to the frequency $f_2$ of the second clock signal corresponds to the ratio of the horizontal scanning resolution in the memory to the horizontal scanning resolution in the display device.

6. A method of transmitting selected portions of data stored in a m1×n1 memory to a m2×n2 display device where m1, m2, n1, n2 are integers with m2<m1, comprising the steps of:

addressing data stored in said memory, reading out data stored in said memory, storing said read out data from said memory into a first storage device, transmitting data from said first storage device to a second storage device at a first rate $f_1$, storing data in said second storage device at a second rate $f_2$ less than said first rate $f_1$ thereby omitting the storage of some of the data transmitted from said first storage device, and selecting $f_1$ and $f_2$ such as to satisfy the relationship $$f_1/f_2=(m1/m2).$$

7. The method as recited in claim 6 further comprising the steps of:

generating X addresses in sequential order to select X addresses of said data stored in said memory, generating Y addresses by selecting a reduced number of Y addresses of said data stored in said memory, said Y address generating including incrementing a given Y address utilizing the ratio n1/n2, where n2<n1, to obtain a new Y address, thereby omitting the generation of some of the Y addresses of said data stored in said memory.

8. A method of transmitting selected portions of data stored in a m1×n1 memory to a m2×n2 display device where m1, m2, n1, n2 are integers with m2<m1, comprising the steps of:

addressing data stored in said memory, reading out data stored in said memory, storing said read out data from said memory into a first storage device, transmitting data from said first storage device to a second storage device in response to a first clock signal having a first frequency $f_1$, storing data in said second storage device in synchronism with a second clock signal having a second frequency $f_2$ less than the frequency $f_1$ of said first clock signal thereby omitting the storage of some of the data transmitted from said first storage device, and selecting $f_1$ and $f_2$ such as to satisfy the relationship $$f_1/f_2=(m1/m2).$$

9. The method as recited in claim 8 further comprising the steps of:

generating X addresses in sequential order to select X addresses of said data stored in said memory, generating Y addresses by selecting a reduced number of Y addresses of said data stored in said memory, said Y address generating including incrementing a given Y address utilizing the ratio n1/n2, where n2<n1, to obtain a new Y address, thereby omitting the generation of some of the Y addresses of said data stored in said memory.

* * * * *